US005429432A

United States Patent [19]

Johnson

[11] Patent Number: 5,429,432

[45] Date of Patent: Jul. 4, 1995

[54] COLLAPSIBLE PLAYROOM

[76] Inventor: Rodney L. Johnson, 9 N. Lake Dr., Kearney, Nebr. 68847

[21] Appl. No.: 231,795

[22] Filed: Apr. 25, 1994

[51] Int. Cl.[6] ..... A47B 83/00; A47B 83/02; A47B 83/04

[52] U.S. Cl. ..... 312/235.3; 312/313; 312/258; 434/432; 190/11

[58] Field of Search ..... 312/235.5, 223.3, 244, 312/249.8, 313; 434/258, 393, 429, 432, 433; 190/11

[56] References Cited

U.S. PATENT DOCUMENTS 3,126,236 3/1964 Buchan et al. .
4,669,789 6/1987 Pemberton .

*Primary Examiner*—Kenneth J. Dorner
*Assistant Examiner*—Anthony Barfield
*Attorney, Agent, or Firm*—John A. Beehner

[57] ABSTRACT

A folding, collapsible playroom adapted for compact storage which is designed to encourage active and creative play by children as opposed to passive activities such as watching television.

The playroom has first and second frames having transversely spaced apart top and bottom walls and opposite side walls all having front and rear surfaces, thereby defining inner and outer frame faces respectively. The frames are pivotally connected such that they may be pivoted from an open, upstanding position to an abutting, closed storage position. Play accessories are included which may be pivotally mounted on one of the frame inner faces and adapted to be moved from a secured stored position to a deployed, play position protruding substantially forwardly from the frame, upon movement of the frames from the closed storage position to the open, upstanding position. The play accessories having a width greater than the width of either of the two frames individually may be releasably secured to one of the frames for storage and removable for play when the frames are opened.

10 Claims, 5 Drawing Sheets

COLLAPSIBLE PLAYROOM

BACKGROUND OF THE INVENTION

1. Technical Field

The method and apparatus of the present invention relate generally to an apparatus and method for a collapsible playroom. More specifically, they relate to an apparatus and method wherein a playroom comprising a plurality of play accessories may be moved from an open play configuration, wherein the play accessories are deployed for use by children, to a closed storage position.

In the closed storage position, the play accessories would be stored internally in the collapsible play room housing unit and would be secured therein. Thus the housing serves both as part of the play environment and as the enclosure/storage mechanism. The closed storage position of the playroom represents a compact configuration wherein it may be stored in limited-space environments such as under a bed or in the back of a vehicle. The interior of the playroom, and the play accessories enclosed therein, are adapted for relatively rigid securement such that the movement of the play accessories, when the playroom is in the closed storage position is greatly restricted. Thus, even though the playroom itself may be jostled about, such as during transportation, the internal accessories will remain secure.

Parents are generally concerned by the amount of time their children spend in a passive entertainment such as in front of a television set, preferring instead that they engage in more active, thought-provoking pursuits. Additionally, it has become commonplace in the early grades of many schools for teachers to construct "learning centers" in their classrooms for the children. The "learning centers" may comprise "tools" from a variety of professions. These "learning centers" thus provide not only entertainment for the children but also a means for learning about different professions. The present invention is well-adapted for use in both the home and school environments. The collapsible playroom can be configured with many different types of play accessories in order to simulate many different work environments such as office, library, hospital, doctor's office, etc.

2. Description of the Prior Art

There are numerous collapsible doll houses which have been adapted for collapsible storage. One example illustrative of such prior art collapsible doll houses is Chase, U.S. Pat. No. 4,883,443, which discloses a collapsible play structure such as a doll house having a plurality of storage drawers and a plurality of parallel and upright side wall panels designed to form various rooms in a house.

Bowersock, et. al., U.S. Pat. No. 1,918,375 discloses a collapsible playhouse large enough for children to enter but which may be collapsed for storage. Bowersock is not adapted to store objects internally when in the collapsed position.

Another example of a prior art device is the "McDonald's Restaurant." In this device, a plurality of restaurant utensils and equipment is provided for play by children. While this is designed with two halves totally connected together to be opened for play or closed for storage, it is not adapted for secure fastening of the internal play accessories during storage. Consequently, a great deal of care must be taken when moving the apparatus about. Additionally, the dimensions of the device when closed do not allow storage in environments such as under a bed nor is it readily transportable. It is also very conspicuous in color, form and dimensions.

While these prior art devices in some cases provide a means for "collapsing" the play structure and internal storage for play accessories, they do not provide a compact device for storage nor a means for rigidly securing the accessories therein. Additionally, these devices are generally unable to accommodate internal storage of accessories having a depth greater than either of the enclosure half sections.

Consequently, there is a great need for a collapsible play structure which may be collapsed into a small and compact space for storage while at the same time providing a means for rigidly securing the accessories therein in order to make the structure more transportable. Additionally, there is a need for a collapsible playroom which is not limited to play accessories having a depth dimension less than that of the enclosure half sections.

Therefore, a primary object of the present invention is to provide a collapsible playroom which is adapted to be collapsed into a structure of small height or width such that it may be easily stored within a small space such as underneath a bed.

Another object of the present invention is to provide a collapsible play structure which is capable of rigidly securing the play accessories therein such that movement of the accessories during transportation is greatly reduced.

Another object of the present invention is to provide a collapsible play structure which is able to accommodate play accessories having a depth greater than either of the two frame halves individually.

Another object of the present invention is to provide a collapsible play apparatus the configuration of which may be easily adapted to different simluated environments such as an office, kitchen, work shop or the like.

Another object of the present invention is to provide a collapsible play apparatus which is relatively lightweight and easily transported about.

Another object of the present invention is to provide a collapsible play apparatus which encourages creative play as opposed to the passive entertainment provided by devices such as television.

Another objective of the present invention is to provide a collapsible play apparatus which is sufficiently durable to withstand the active use by children.

Another object is to provide a play structure which may be used as an "activity center" in a school environment, incorporating educational activities, e.g. clock with movable hands, "calculator", weights and measures, etc Another objective of the present invention is to provide a collapsible play apparatus which is self-contained.

Another objective of the present invention is to provide a collapsible play apparatus which is capable of accommodating detachable accessories.

Another object of the present invention is to provide a collapsible play structure which is adapted to accommodate a locking means for locking the apparatus in the closed storage position, such that when closed, it becomes inconspicuous.

A final objective is to provide a collapsible play structure of relatively neutral exterior color and texture so as to be inconspicuous.

SUMMARY OF THE INVENTION

The present invention discloses a folding, collapsible playroom adapted for compact storage which is designed to encourage active and creative play by children as opposed to passive activities such as watching television.

The playroom has a first frame having transversely spaced apart top and bottom walls and opposite side walls all having front and rear surfaces, thereby defining inner and outer frame faces respectively. The frame has a width between the front and rear surfaces which is less than one quarter of the transverse dimension of the frame opposite side walls. A first back panel attached to the outer face the first frame. A second frame has transversely spaced apart top and bottom walls and opposite side walls all having front and rear surfaces, thereby defining inner and outer frame faces respectively. The frame has a width between the front and rear surfaces which approximates the first frame width. A second back panel is attached to the outer face the second frame. A means for pivotally connecting the first and second frames is included such that the first and second frames may be pivoted from an open, upstanding position to an abutting, closed storage position.

A first play accessory is pivotally mounted on one of the frame inner faces and adapted to be moved from a secured stored position to a deployed, play position protruding substantially forwardly from the frame, upon movement of the frames from the closed storage position to the open, upstanding position. At least a second play accessory is included having a width greater than the width of either of the two frames individually and adapted to be releasably secured to one of the frames. When releasably secured, the second play accessory protrudes forwardly from the frame. Upon movement of the first and second frame to the closed storage position, movement of the second play accessory is substantially restricted. When the frames are moved to the open, upstanding position, the second play accessory is removable for play.

DESCRIPTION OF THE PREFERRED EMBODIMENT

In the modern household, storage space is at a premium. With children around the house, this problem is greatly exacerbated. Little ones tend to have many different types of toys and tend to scatter them about. Additionally, compounding the problem is the fact that many of these toys are not adapted for easy and compact storage thus quickly devouring any storage space available in the house. Still further, such toys are not adapted for easy transportation when the family travels out of town. Consequently, there is a great need and utility in a playroom apparatus which creates a self-contained play environment comprising numerous play accessories for entertainment of the children and which is adapted to be completely self-contained and sized for ease of compact storage and transportation. The present invention is just such a device. It is adapted to be opened in a play configuration wherein most of the various play accessories are adapted for internal connection and where the accessories are adapted for internal storage in a compact profile which may be easily stored under a bed or in a closet or transported in a vehicle. Additionally, the exterior surface may be of a neutral color and texture so as to render the apparatus relatively inconspicuous.

Perhaps of even greater concern and interest to parents of today's children is the amount of time spent on passive entertainment such as in front of a television set. In general, parents are more interested in seeing their children engaged in more creative, thought-provoking play. The present invention provides just such inducement and encouragement to children to engage in creative play.

In addition to the home environment, the present invention is especially well suited for use in a school environment. Many teachers in the earlier grades Construct "learning centers" in their classrooms for the students. These teachers use "tools" from different work settings in order to simulate different working environments such as office, hospital, dentist office and the like. These "learning centers" are usually constructed from scratch using materials the teachers finds or purchases. These teachers thus provide their students with not only entertainment but also an opportunity to learn about different professions. In addition to the "simulated" hardward used to create the work environment, the teacher may also include some actual working devices such as lights, calculators, and other learning devices and computers to further the learning experience.

The collapsible playroom of the present invention is especially well suited for both the school and home settings. The internal accessories may be selected so as to simulate many different working environments and its moving parts are sure to capture the attention of students at school and home. Its ease of storage and transport are attractive to both teachers and parents.

Figure 1:
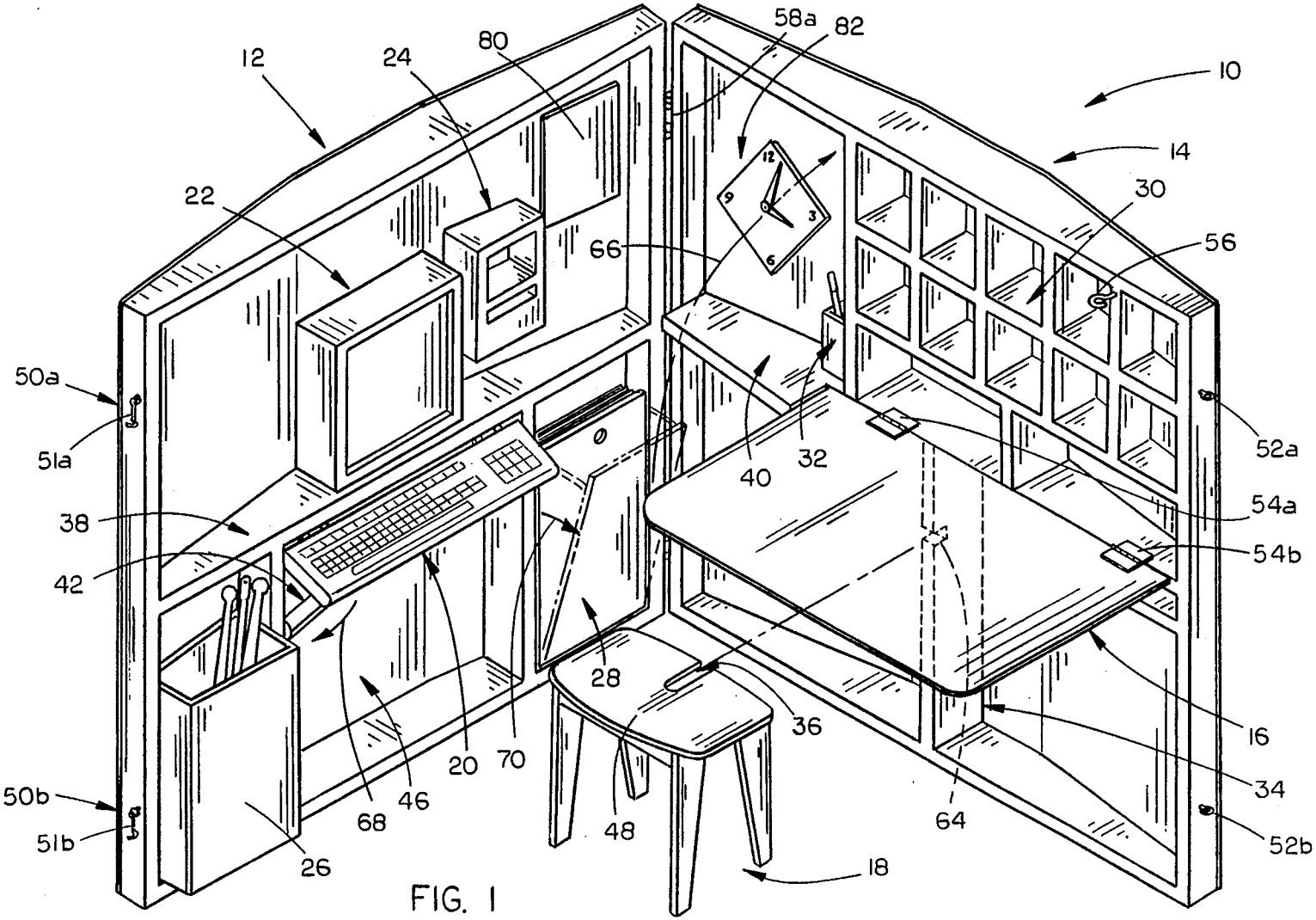
FIG. 1 is a front view showing the playroom opened in the play configuration with all of the various play features deployed.

The open, play configuration of the present invention is best illustrated by FIG. 1. As shown in the figure, the collapsible play apparatus 10 comprises first and second frame half sections 12 and 14, respectively. First and second frame half sections 12 and 14 are pivotally attached to one another along one edge of each frame by means of hinges 58A and B. In the embodiment illustrated by FIG. 1, the collapsible play apparatus 10 is configured to simulate an office environment. In the preferred embodiment, the outer surfaces of half sections 12 and 14 are manufactured of plastic but this is not essential. As described herein below, the collapsible play apparatus 10 may be adapted for numerous playroom configurations some examples of which are the office environment, a kitchen, a shop workroom, beauty shop, doctor's office and the like. In these different embodiments, the play accessories would be varied to accommodate the particular playroom configuration desired.

In the office embodiment illustrated by FIG. 1, the playroom accessories comprise fold-down table 16, bench 18, computer keyboard 20, computer screen 22, disk drives 24, wastebasket 26, file 28, storage cabinets 30, pencil holder 32, bulletin board 80, and clock 82. In addition, bench 18, provided for the children to sit on, may be secured within frame 14 by means of slot 36 in seat 48 which is adapted to receive vertical support member 34 therein. Additionally, vertical support member 34 comprises slot 64 for receiving seat 48. Thus, when the collapsible play apparatus 10 is moved to the closed storage position illustrated by FIG. 3, the bench 18 is restricted from any substantial movement in either the horizontal or vertical directions. This facilitates transport of the playroom apparatus from one place to another.

Keyboard 20 and table 16 are pivotally connected to horizontal support members 38 and 40, respectively. Thus when keyboard 20 and table 16 are to be moved to the storage position illustrated in FIG. 3, they may be pivoted into position for storage. When the apparatus is opened to the upstanding position shown in FIG. 1, the keyboard 20 and fold-down table 16 may be pivoted into the deployed play position as shown in FIG. 1. An auxiliary support member is also illustrated in FIG. 1 for rigidly supporting the keyboard 20 in the play position. The member 42 may be pivoted into position as shown and secured therein by means of strap 44. This auxiliary support means is more clearly illustrated below in FIGS. 6 and 7. As seen in the figure, the other play accessories such as computer screen 22, disk drives 24 and the like, are secured to various vertical and horizontal support members within frame half sections 12 and 14 such that when the apparatus 10 is collapsed into the closed storage position, these additional play accessories are restricted from any movement within frames 12 and 14. Locking means 50*a* and *b* may be a simple hook and eye combination and operate to keep sections 12 and 14 locked together for storage. Thus, the apparatus 20 can be transported from one place to another without internal movement of the components.

Figure 3:
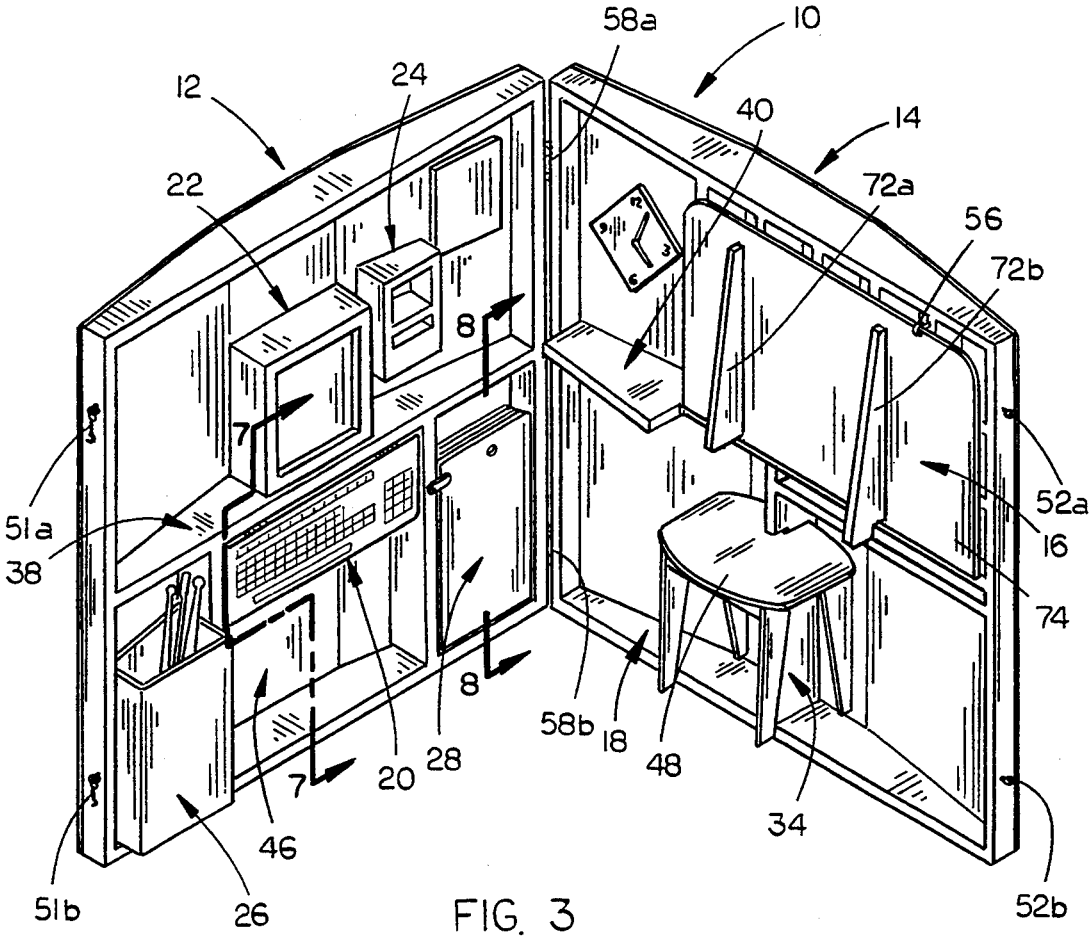
FIG. 3 is a front view with the playroom opened but with the play features in the storage position.

FIG. 3 illustrates the storage configuration for fold-down table 16, keyboard 20, file 28 and bench 18. As seen in the figure, table 16 is adapted to fold upwardly so as to cover open shelves 30 and to allow frames 12 and 14 to be pivoted together for closure. Similarly, simulated keyboard 20 is adapted to be pivoted downwardly so as to allow frames 12 and 14 to be closed.

Figure 4:
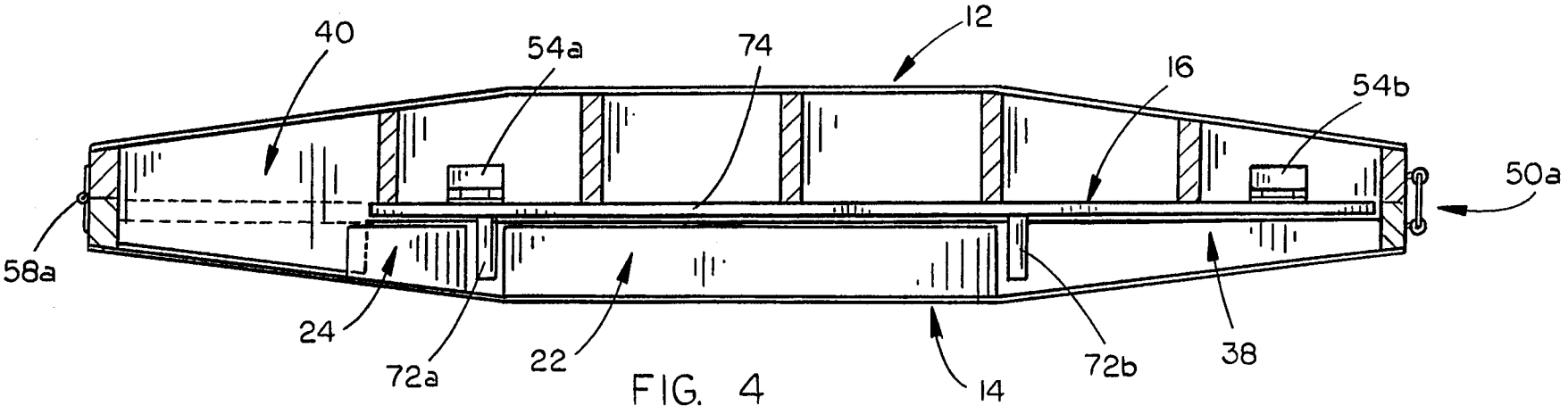
FIGS. 4 and 5 are end sectional views taken along the lines indicated in FIG. 2 to show the various internal configurations of the components when the playroom is in the closed storage position.
Figure 5:
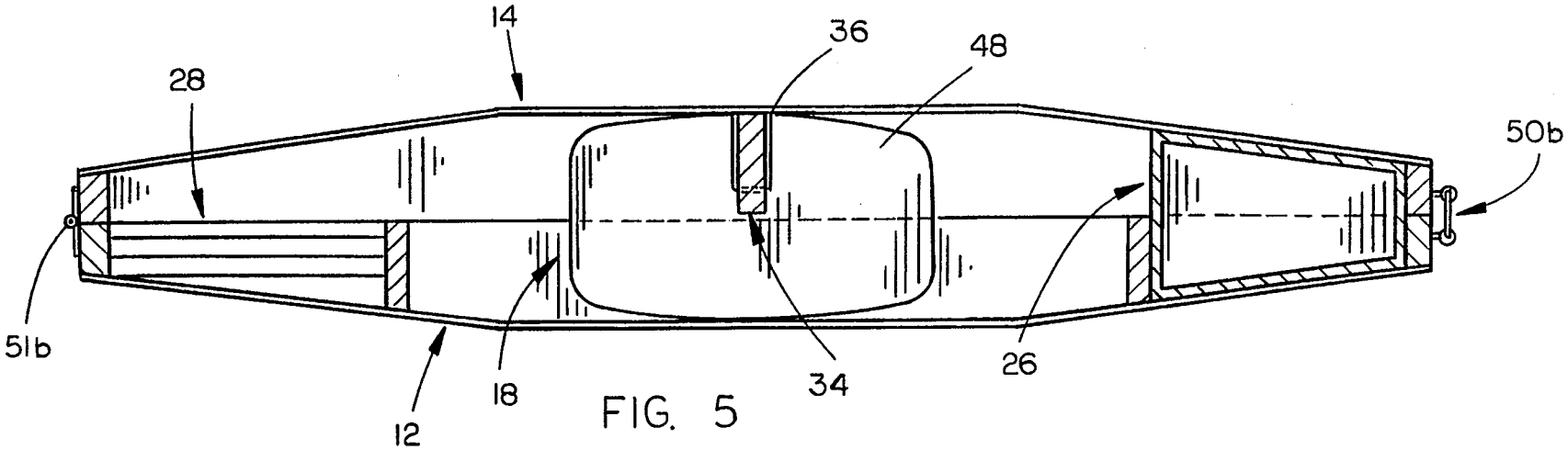

Installation of bench 18 in frame 14 illustrates an especially significant and distinguishable feature of the present invention. As shown in the figure, bench 18 comprises a slot 36 which is adapted to receive vertical support member 34. Additionally, frame half section 12 includes a recessed area 46 which is adapted to receive the forward section of bench seat 48. Thus, the apparatus 10 is able to accommodate play features which have a dimension that exceeds the width of any one of the two frame half sections 12 or 14 individually. The bench 18 has a seat 48 with a width dimension sufficiently large so as to cause seat 48 to project forwardly of frame 14. However, due to the receiving slot 36 and the recess 46, the apparatus 10 is able to accommodate an accessory such as 18 which has a dimension causing it to protrude forwardly of the frame 14. FIGS. 4 and 5 are particularly helpful in showing how frame half section 14 is adapted to receive the protruding portions of bench 18 and table 16, as well as how other internal components are accommodated in the closed storage position.

Figure 2:
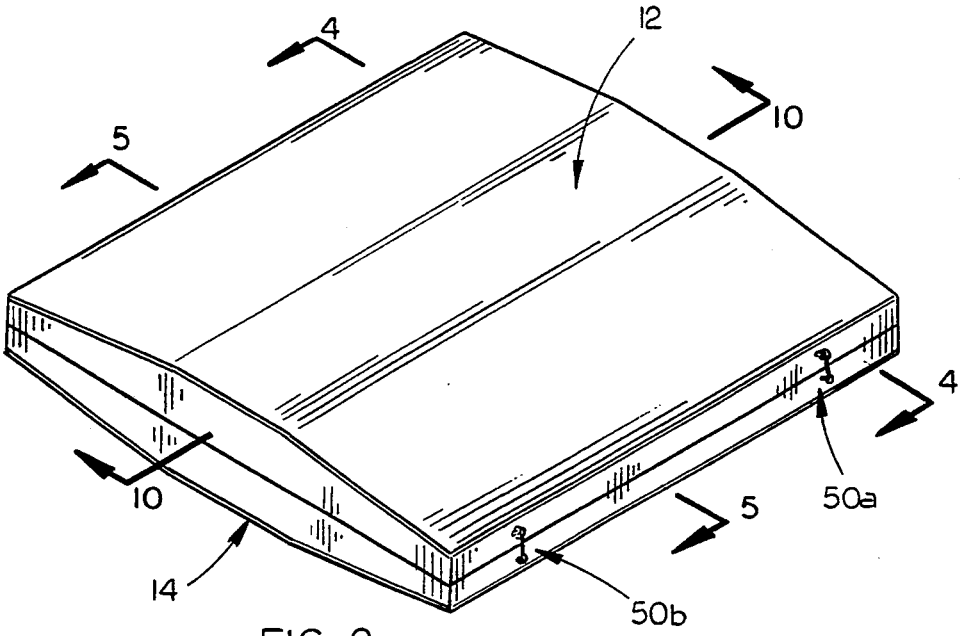
FIG. 2 is a perspective view showing the playroom closed for storage.

FIGS. 4 and 5 are sectional side views taken along the lines indicated in FIG. 2. FIG. 4 is a top sectional view showing in detail the arrangement of the internal components when the collapsible playroom 10 is in the closed storage position. As shown, table 16 is secured to horizontal support member 40 by means of hinges 54*a* and *b*. The size, shape and orientation of disk drives 24 and computer screen 22 allow the table support arms 72*a* and 72*b* to be received within the space of second frame half section 14. Thus, as described above and as is illustrated in the figure, the apparatus 10 is able to accommodate play accessories such as table 16 which protrude from the frame half section in which they are mounted.

FIG. 5 is another sectional view taken along the lines indicated in FIG. 2, somewhat lower along the vertical axis of the apparatus 10 than that of FIG. 4. Shown clearly by FIG. 5 is the ability of the apparatus 10 as described above to accommodate play accessories having dimensions which cause them to protrude from a frame half section. In FIG. 5, this ability is illustrated using the bench 18. As illustrated earlier, bench 18 comprises seat 48 in which there is cut a receiving slot 36. Receiving slot 36 is adapted to receive vertical support member 34 of frame half section 14 when in the storage position. Thus, bench 18 is prevented from any substantial lateral movement during storage. Additionally, vertical support member 34 comprises slot 64 (FIG. 10) for receiving bench seat 48, thus, when bench 18 is slidably engaged with vertical support member 34, bench 18 is restricted in both vertical and horizontal movements. Consequently, bench 18 is prevented from any substantial internal movement during storage or transportation of the playroom apparatus 10. Also shown in the figure, are the internal locations and placement of the file 28 and wastebasket 26 when the playroom apparatus 10 is in the closed storage position. As shown, the size and shape of wastebasket 26 is such that it is able to protrude forwardly of frame half section 12 to which it is secured, and into an area comprising frame half section 14.

Figure 7:
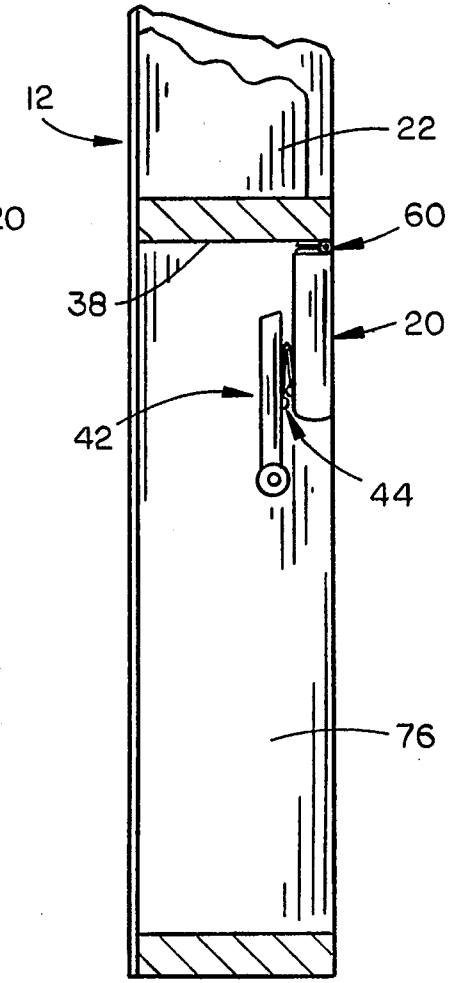
FIGS. 6 and 7 are side sectional views showing the keyboard in the deployed and closed storage positions, respectively.
Figure 6:
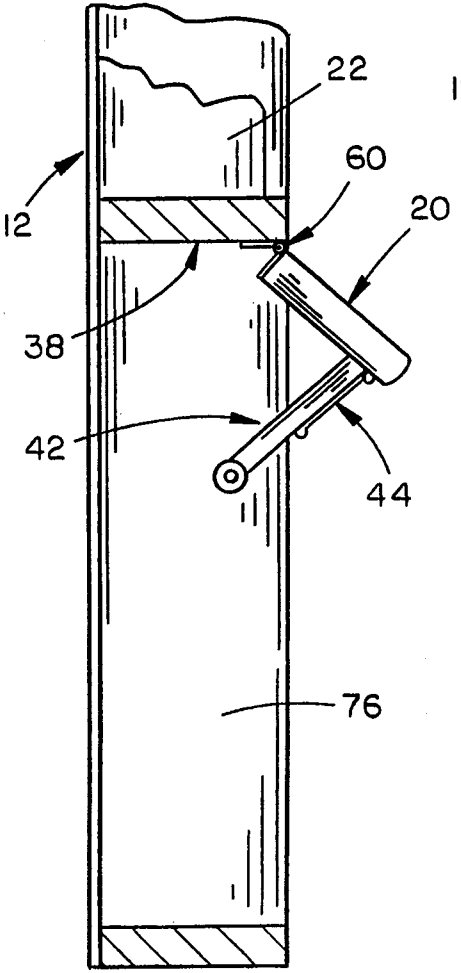

FIGS. 6 and 7 illustrate another important feature of the invention and another manner in which play accessories protruding beyond the front of one half section may be accommodated when deployed in the play position, yet internally contained when in the closed storage position. Deployment in the play configuration of the keyboard 20 is illustrated by FIG. 6. As seen in the figure, keyboard 20 is pivotally connected to support member 38 by means of hinge 60. Thus, the keyboard is capable of being pivoted from the deployed play position as shown in FIG. 6 to the closed storage position shown in FIG. 7. When the simulated keyboard 20 is in the deployed play position, it may be maintained therein by means of keyboard support brace 42 which is in turn pivotally connected to vertical support member 76. When the keyboard is in the deployed play position, as illustrated in FIG. 6, the support brace 42 may be pivoted outwardly to contact the lower portion of the keyboard 20 as shown. Thus, the keyboard is prevented from pivoting backwards into the closed storage position due to physical contact with the support brace 42. Connection strap 44, secured to both support brace 42 and simulated keyboard 20, prevents support brace 42 from pivoting too far outwardly so as to disengage keyboard 20. As shown in FIG. 7, when the simulated keyboard 20 is to be moved to the closed storage position, the support brace 42 is pivoted backwards which allows simulated keyboard 20 to pivot down and back and into the substantially vertical position as shown. Due to the flexibility of securement strap 44, it is adapted to be folded as shown when keyboard 20 and support brace 42 are pivoted into the closed storage position.

Figure 9:
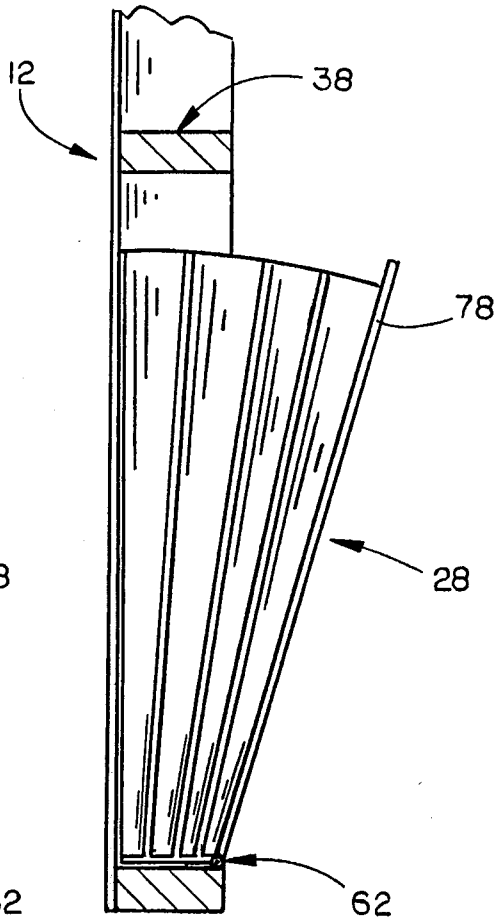
FIGS. 8 and 9 are side sectional views showing the file folder apparatus in the closed and open positions, respectively.
Figure 8:
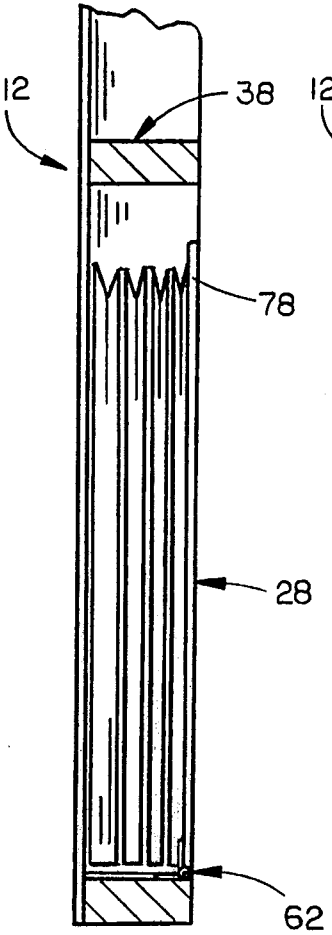

FIGS. 8 and 9 are side sectional views showing the installation and movement of the file folder 28. As shown in the figure (and also FIG. 5), in the closed storage position, file 28 fits substantially within the confines of frame half section 12. As seen in the figure, file front 78 is pivotally connected to frame 12 by means of hinge 62. To deploy file 28 from the closed storage position of FIG. 8 to the deployed play position of FIG. 9, the child merely pivots file front 78 outwardly as shown in FIG. 9. This causes file 28 to expand openly so as to receive object therein.

Figure 10:
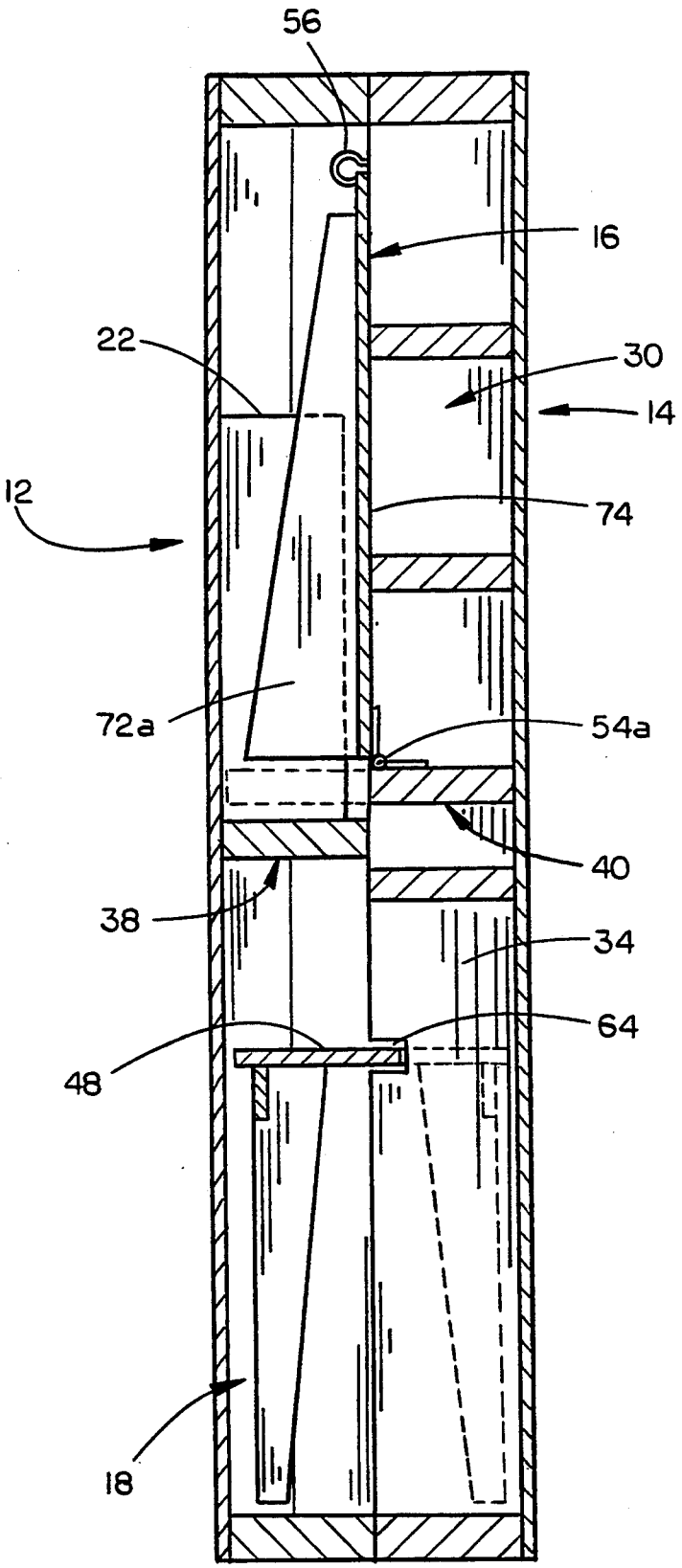
FIG. 10 is another side sectional view taken along the lines indicated in FIG. 2 showing the internal storage configuration of various components.

FIG. 10 is a sectional view taken along the lines indicated in FIG. 2 showing in particular the internal arrangement of play accessories when the playroom apparatus 10 is in the closed storage position. As seen again clearly in this figure, the playroom's ability to accommodate play objects having a width greater than either of the two individual frame half sections 12 or 14, individually. Specifically, the bench 18 is shown in the installed closed storage position wherein the bench seat 48 has slidably received vertical support member 34. As mentioned above, this substantially reduces any lateral movement of bench 18 when the playroom apparatus 10 is in the closed storage position. Additionally, bench 18 is secured in position by means of slot 64 contacting seat 48 of bench 18 which is operative to prevent any substantial vertical movement of bench 18. Also shown in the figure is the positioning of table 16 in the closed storage position. As shown, table 16 is pivoted into the substantially vertical position for storage. Such pivoting is permitted by virtue of the connection of table 16 to horizontal support member 40 by hinges **54*a* and 54*b* (not shown). The end portion of horizontal support member 40 may also function as a shelf for a telephone (not shown). The design and positioning of simulated computer screen 22 is such that screen 22 fits between table support arms 72*a* and *b* (not shown) which are adapted to be received within the frame half section 12. Also shown in FIG. 10 is the operation of table locking means 56. In the preferred embodiment, locking means 56 may be a simple eyelet screw which is adapted to be rotated into locking position as shown when the table is in the upright closed storage position. For locking, the locking means 56 would engage the lower surface of table 74** thereby preventing it from pivoting downward.

It is obvious that numerous other modifications and variations of the present invention are possible in view of the above teachings. For example, an important modification previously mentioned is to incorporate a variety of playroom accessories in order to simulate different work or play environments. For example, a workshop could be simulated by replacing the computer accessories described above with a simulated table saw, vise, power tools and the like. Similarly, a beauty shop environment could be simulated by replacing the above computer accessories with a hair dryer, mirror, salon chair or the like. Other environments might be baby room, kitchen, store, soda fountain, doctor's office and the like. Obviously, the number of different environments is limited only by the imagination. Additionally, the number or type of accessories even within a given simulated environment is quite large. For example, some obvious features which could be added to the simulated office would be a phone, clock or the like. Still further, the size of the playroom can be different, based on the age and size of the child. In my preferred embodiment, the playroom would be approximately three feet wide when fully opened, and approximately 30 inches in height. Further, I have curved the outer surface of the frame half sections 12 and 14 such that they are approximately seven inches thick in the center and three inches at the ends. It is felt that such curvature makes the playroom easier to slide under a bed or into a closet. Obviously this may be modified without changing the character of the invention.

Therefore, it is to be understood that the above description is intended in no way to limit the scope of protection of the claims and is representative of only one of the several possible embodiments of the present invention.

Thus there has been shown and described an invention which accomplishes at least all of the stated objectives.

I claim:

1. A folding, collapsible playroom adapted for compact storage and comprising:

a first frame having vertically spaced apart top and bottom walls and opposite transversely spaced apart side walls all having front and rear surfaces, thereby defining inner and outer frame faces respectively, said frame having a width between said front and rear surfaces which is less than one quarter of the transverse dimension of said frame opposite side walls;

a first back panel attached to said outer face said first frame;

a second frame having transversely spaced apart top and bottom walls and opposite side walls all having front and rear surfaces, thereby defining inner and outer frame faces respectively, said frame having a width between said front and rear surfaces which approximates said first frame width;

a second back panel attached to said outer face said second frame;

means for pivotally connecting said first and second frames such that said first and second frames may be pivoted from an open, upstanding position to an abutting, closed storage position;

a first play accessory pivotally mounted on one of said frame inner faces and adapted to be moved from a secured stored position to a deployed, play position protruding substantially forwardly from said frame, upon movement of said frames from said closed storage position to said open, upstanding position; and a second play accessory having a width greater than the width of either of the two frames individually and adapted to be releasably secured to one of said frames, said second play accessory protrudes forwardly from said frame in a secured position and such that upon movement of said first and second frame to the closed storage position, movement of said second play accessory is substantially restricted by at least one of said back panels and such that upon movement of said frames to said open, upstanding position, said second play accessory is removable for play.

2. The collapsible playroom of claim 1 further comprising a locking means secured to each of said first and second frames and adapted to lock said first and second frames in said closed storage position.

3. The collapsible playroom of claim 1 wherein said first and second frames are generally rectangular in shape.

4. The collapsible playroom of claim 1 wherein said collapsible playroom when in said closed storage position is less than 12 inches thickness.

5. A folding, collapsible playroom adapted for compact storage comprising:

an enclosure including two generally half sections;

each half section including a top wall, bottom wall, transversely spaced apart opposite side walls, each wall having front and back edges, and a back panel connected to and extended between said top, bottom, and side walls adjacent the back edges thereof;

means for pivotally connecting said half sections together along adjacent side walls;

a first play accessory pivotally mounted on one of said half sections and adapted to be moved from a secured stored position to a deployed, play position protruding substantially forwardly from said half section, upon movement of said half sections from said closed storage position to said open, upstanding position; and a second play accessory having a width greater than the width of either of the two half sections individually and adapted to be releasably secured to one of said half sections, said second play accessory protrudes forwardly from said half section in a secured position and such that upon movement of said half sections to the closed storage position, movement of said second play accessory is substantially restricted by at least one of said back panel and such that upon movement of said half sections to said open, upstanding position, said second play accessory is removable for play.

6. A folding, collapsible playroom adapted for compact storage and comprising:

a first frame having vertically spaced apart top and bottom walls and opposite transversely spaced apart side walls all having front and rear surfaces, thereby defining inner and outer frame faces respectively, said frame having a width between said front and rear surfaces which is less than one quarter of the transverse dimension of said frame opposite side walls;

a first back panel attached to said outer face said first frame;

a second frame having transversely spaced apart top and bottom walls and opposite side walls all having front and rear surfaces, thereby defining inner and outer frame faces respectively, said frame having a width between said front and rear surfaces which approximates said first frame width;

a second back panel attached to said outer face said second frame;

means for pivotally connecting said first and second frames such that said first and second frames may be pivoted from an open, upstanding position to an abutting, closed storage position;

a first play accessory pivotally mounted on one of said frame inner faces and adapted to be moved from a secured stored position to a deployed, play position protruding substantially forwardly from said frame, upon movement of said frames from said closed storage position to said open, upstanding position;

a bench having a width greater than the width of either of the two frames individually and adapted to be releasably secured to one of said frames such that when releasably secured, said bench protrudes forwardly from said frame and such that upon movement of said first and second frame to the closed storage position, movement of bench is substantially restricted and such that upon movement of said frames to said open, upstanding position, said bench is removable for play, said bench having a seat and support means secured thereto and further wherein said bench includes a slot in said seat adapted to receive one of said frame vertical members such that said bench is releasably secured between said first and second frames when in said closed storage position and removable to a play position when said frames are moved to said open, upstanding position; and a plurality of vertical and horizontal support members mounted to said first and second frames and adapted to support said first and second play accessories.

7. The collapsible playroom of claim 6 further comprising a plurality of vertical and horizontal support members mounted to said first and second frames and adapted to support said first and second play accessories.

8. The collapsible playroom of claim 6 wherein said first accessory comprises a simulated computer keyboard and wherein said keyboard is pivotally attached to one of said frames such that said keyboard is movable from a stored position to a deployed play position when said frames are moved from said closed storage position to said open, upstanding position.

9. The collapsible playroom of claim 8 further comprising a support member adapted to be positioned between said keyboard and said frame such that said keyboard is supported in said deployed, play position.

10. A folding, collapsible playroom adapted for compact storage and comprising:

a first frame having vertically spaced apart top and bottom walls and opposite transversely spaced apart side walls all having front and rear surfaces, thereby defining inner and outer frame faces respectively, said frame having a width between said front and rear surfaces which is less than one quarter of the transverse dimension of said frame opposite side walls;

a first back panel attached to said outer face said first frame;

a second frame having transversely spaced apart top and bottom walls and opposite side walls all having front and rear surfaces, thereby defining inner and outer frame faces respectively, said frame having a width between said front and rear surfaces which approximates said first frame width;

a second back panel attached to said outer face said second frame;

means for pivotally connecting said first and second frames such that said first and second frames may be pivoted from an open, upstanding position to an abutting, closed storage position;

a first play accessory pivotally mounted on one of said frame inner faces and adapted to be moved from a secured stored position to a deployed, play position protruding substantially forwardly from said frame, upon movement of said frames from said closed storage position to said open, upstanding position; and a second play accessory having a width greater than the width of either of the two frames individually and adapted to be releasably secured to one of said frames, said second play accessory protrudes forwardly from said frame in a secured position and such that upon movement of said first and second frame to the closed storage position, transverse movement of said second play accessory is substantially restricted by a least one of said back panel and such that upon movement of said frames to said open, upstanding position, said second play accessory is removable for play.

* * * * *